United States Patent [19]

Monti, Jr.

[11] 4,315,114

[45] Feb. 9, 1982

[54] KEYBOARD SWITCH ASSEMBLY

[75] Inventor: James H. Monti, Jr., Corinth, Miss.

[73] Assignee: International Telephone and Telegraph Corporation, New York, N.Y.

[21] Appl. No.: 133,566

[22] Filed: Mar. 24, 1980

[51] Int. Cl.[3] ..... H01H 13/70

[52] U.S. Cl. ..... 200/5 A; 200/159 A; 200/159 B; 200/340

[58] Field of Search ..... 200/5 A, 159 R, 159 A, 200/159 B, 329, 340; 340/365 R

[56] References Cited

U.S. PATENT DOCUMENTS 4,066,860 1/1978 Kawasaki ..... 200/340

4,127,752 12/1978 Lowthorp ..... 200/275

*Primary Examiner*—R. L. Moses

*Assistant Examiner*—Morris Ginsburg

*Attorney, Agent, or Firm*—James B. Raden; Marvin M. Chaban

[57] ABSTRACT

A keyboard assembly for a multiple button array in which each push button is individually pivotal about a resilient hinge which is deformable throughout its length or a "living hinge" mounting to a support structure. The engagement of the hinge mounting to a push button is located adjacent the end of the button most remote from the connection of the hinge to its support structure. The hinge mechanism for each button comprises plastic straps extends along both sides of the button to the connection to the button. The hinge axis for the straps is spaced a distance from the near side of the button to produce a button movement of a translatory rather than pivotal movement. The button array disclosed is suitable for use as a telephone push button dialer.

8 Claims, 7 Drawing Figures

KEYBOARD SWITCH ASSEMBLY

BACKGROUND OF THE INVENTION

Push button key block or keyboard assemblies are widely used to enter information in electrical and electronic systems. Telephone push button dials provide one usage of such devices to enter call control information into the telephone system. For computers and calculators, such devices act to enter data for manipulation within the calculator or computer.

The earlier key blocks in the telephone art used the principle of U.S. Pat. No. 3,109,071 issued to C. E. Mitchell et al. on Oct. 29, 1963. With electronic tone generators replacing the inductive-capacitive generators used with Mitchell key block, push button assemblies similar to those used in the computer arts become practical. For example, U.S. Pat. No. 4,029,916 issued to Chu on June 14, 1977 shows one form of pivoted individual button type usable for a telephone push button dial. A number of other patents issued covering computer key block assemblies applicable to telephone dials. The more relevant of these are U.S. Pat. Nos. 4,032,729 to Koistenen (June 28, 1977); 4,160,886 to Wright (July 10, 1979) and 4,096,364 (June 20, 1978).

In these patents are shown an array of push buttons individually hinged or resting in an enclosure. A push button when depressed acts against the effect of a spring to complete a contact path through a pair of stationary contacts, normally spaced apart, as for example, on a printed circuit board. The contact is a momentary one continuing for the period during which the button remains depressed. When the depressing force on the button is released, the spring restores the button to its normal condition and the electrical contacts are returned to an open circuit condition.

SUMMARY OF THE INVENTION

The present invention is directed to a keyboard or key block assembly especially of the type adapted for use in a telephone push button dialer. The key or button which is adapted to be actuated on depression is hinged to a cross brace or transverse support member, the cross brace having hinged thereto the plurality of buttons of one alignment.

Each button is hinged to the cross brace by a pair of hinge arms, one such hinge arm on each side of the button. The hinge arms extend from side connections to the button adjacent one end of the button to a connection to the cross brace spaced past the opposite end of the button. One cross brace preferably provides the support for the buttons of a row. The cross braces may be joined with other cross braces representing other rows of button, the cross braces forming a sheet of material extending in a plane below the face plate of the assembly.

An array of buttons, cross braces and hinges may be molded as a single unit with the hinges integrally connected to the buttons and cross braces.

Beneath each buton may be positioned any of a number of different types of contact members. The primary type of contact shown herein has a domed resilient member providing restoring force for returning the button to its unoperated condition. In one form, a conductive contact adhered to the underside of domed member may be used to complete a circuit path between spaced contacts on a printed circuit board spaced from and supporting the domed member thereon. The dome member may be one of an array affixed to an integral sheet of rubber or plastic material having rubber-like qualities.

A more conventional type of sheet metal spring member having a fan array of contacts may be positioned beneath each button in place of the resilient layer previously described.

With other switch contact construction, a button when depressed causes its hinge arm to pivot adjacent the cross brace spaced from the opposite end of the button. The hinge arms also yield adjacent their connection to the button to produce a translatory rather than pivotal motion of the button.

DETAILED DESCRIPTION OF THE DRAWING

Figure 1:
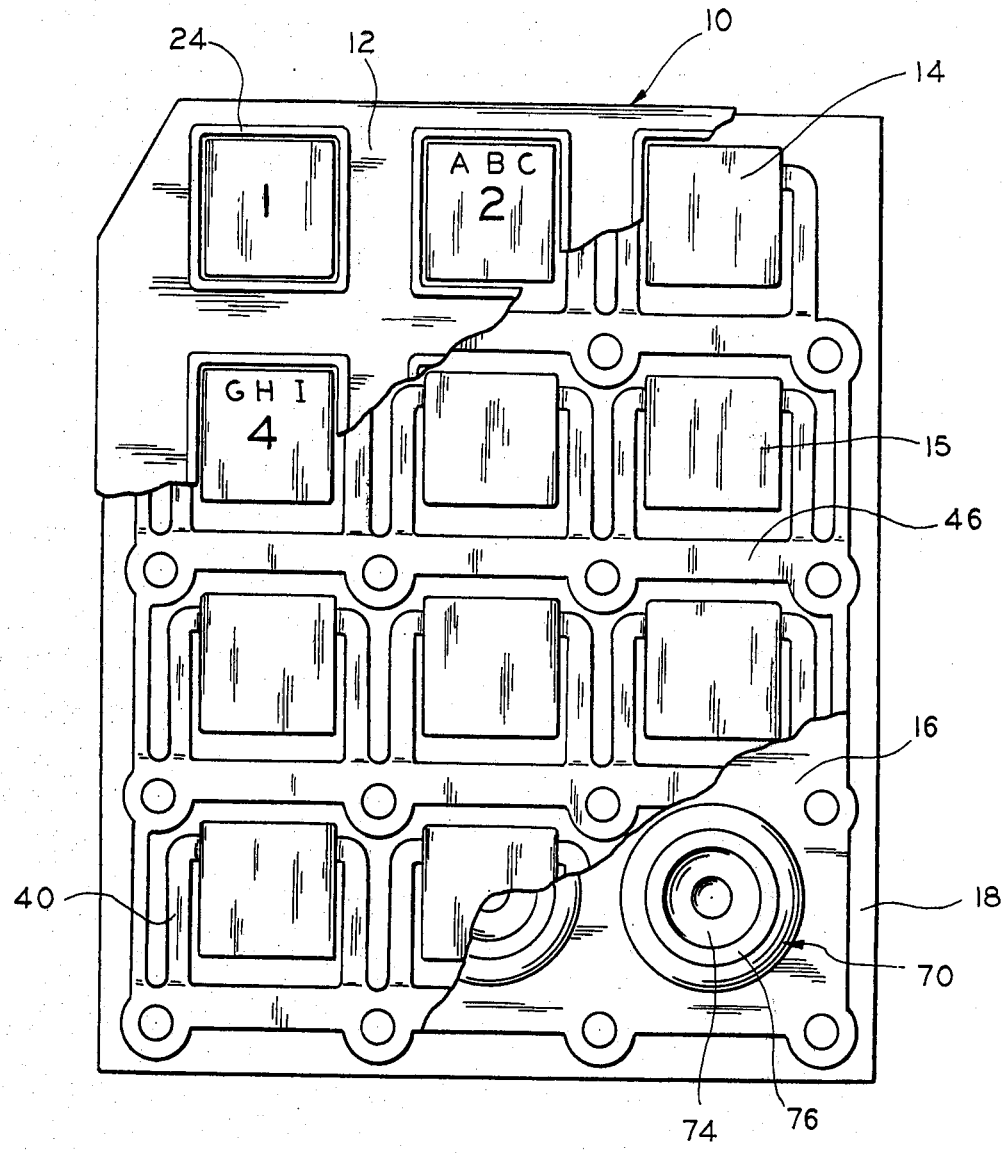
FIG. 1 is a plan view of a keyboard assembly using my invention and broken away to show internal portions thereof.

In FIG. 1, I show a key block or push button dialer assembly 10 having an upper face plate 12, partially broken away to show the pushbutton layer 14 adjacent to the face plate. This layer includes the push buttons 15 extending through the face plate and individually depressible relative to the face plate. The push button layer 14 is partially broken away to show the button restoring and contact operating layer 16. The button member of the assembly is a generally rigid base plate 18 (shown in FIG. 2), the inner surface 20 of which may carry a printed circuit.

The layers have approximately similar planar configuration with the operative elements aligned to provide twelve push buttons or keys 15 in an orthogonal array of four row and three columns of independently operative buttons. As is now conventional, depression of a button momentarily closes an electrical contact path. Release of the depressive force on the button restores the button to its normal state with the contact path open.

Turning to my construction in greater detail, the upper face plate 12 may be conventional, for example, similar to that shown by U.S. Pat. No. 3,316,357 issued Apr. 25, 1967 to J. H. Ham et al. The face plate 12 has rectangular openings 22 for the respective push bottons. Each opening 22 is bordered by an upstanding wall 24 to aid in constraining the movement of the respective buttons to translatory movement. The face plate 12 is conventionally molded of plastic and is designed to provide the appearance face of the assembly.

Figure 2:
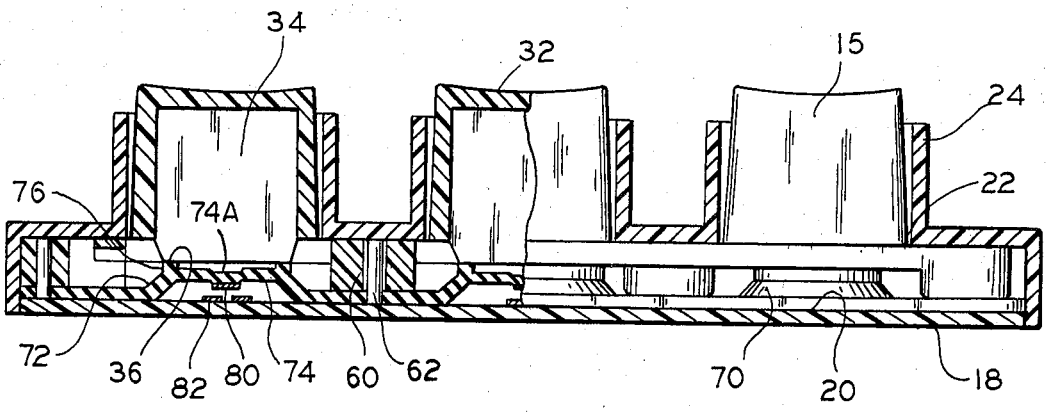
FIG. 2 is a side view partially in section of the assembly of FIG. 1.

The push button layer 14 is comprised of an orthogonal array of push buttons 15 with a button for each opening 22. Each button 15 is essentially frusto-pyramidic in profile as shown in FIG. 2 with a finger receiving concavity or depression 30 in the exposed surface 32. The top surface 32 which is exposed when the buttons are mounted in openings 22 may be lettered with suitable identifying indicia as is conventional.

The interior of each button may be hollow with a central spinal strut 34 terminating in a nose portion on 36 which extends beyond the lower edge 38 of the button wall (as seen best in FIG. 2). The nose portion 36 has its left and right edges slanted as shown in FIG. 2 so that the lower end of nose 36 is equal in length to the diameter of the mating surface of dome 72. Each button has two hinge arms 40, one on each side affixed to its lower edge 38 in a thickened jointing area 42 adjacent one end 44 of the button. The hinge arms 40 extend parallel to the body of the button adjacent the bottom edge thereof and extend to a cross support brace 46 for the buttons of a row. For the major portion of its length, each hinge arm 40 is narrower in section than its jointing area 42 and narrower than the brace 46 to render the arms more resilient and flexible than the cross brace and more resilient than the jointing area.

The cross brace 46 is spaced away from the adjacent end of the button a distance slightly less than the one half the width of a button to provide a travel path for the arm sufficient to cause closure of the contact path as will be described.

Figure 3:
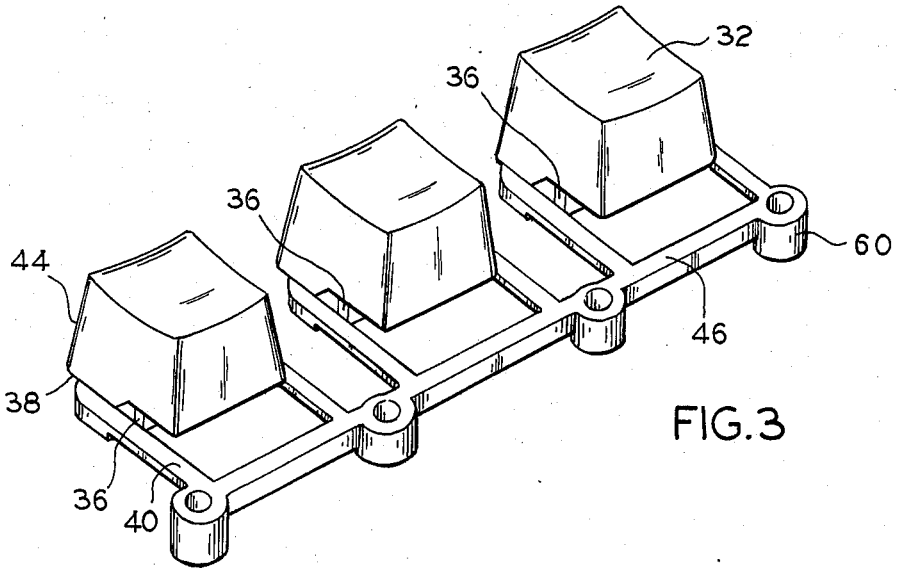
FIG. 3 is a view in perspective of one row of buttons of the type generally shown in FIG. 1.
Figure 4:
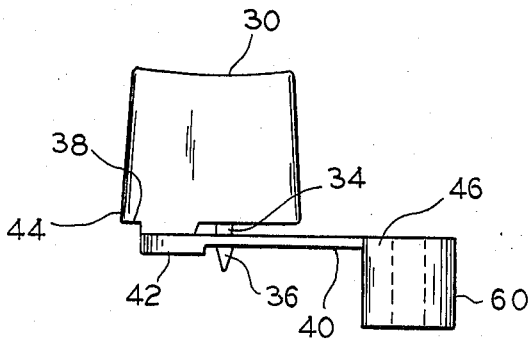
FIG. 4 is a side view in elevation of the row of buttons of FIG. 3.

At each side of a button, the brace 46 has a mounting tube 60. Thus, for a row of three buttons, there are four equally spaced mounting tubes, the tubes adapted to mount on spaced locating dowel pins 62 upstanding from the base plate 18. As shown in FIG. 1, the cross braces may be joined at their outer ends to form the button rows into a single member for ease of assembly. Alternatively, as shown in FIGS. 3 and 4, the braces may be separate for individual mounting. In either event, the mounting, relative position and operation of a button are identical.

To provide the resultant circuit closure and button restoration, the layer 16 is used comprised of a continuous sheet of rubber-like plastic or rubber. The sheet provides a moisture barrier protecting the contacts and printed circuit. The sheet has a plurality of raised domes 70 arrayed in the orthogonal pattern of the buttons and apertures in the face plate. The sheet has openings for the locating dowels 62 to position a dome beneath each button in the assembled keyblock assembly.

A dome, as seen best in FIG. 2, is integral with the sheet and has a domed base section 72 leading to a central disc 74. The discs of the respective domes are aligned in a plane space above the sheet proper and spaced a distance above the base plate 18. The wall 76 of each dome extend above the disc in a tubular extension which normally engages nose portion 36 of the adjacent button central strut to hold the button in its normal condition by the inherent resilience of the dome walls. Each disc may have its upper surface recessed (as seen in FIG. 2 at 74A) to provide contact overtravel.

Each disc has a conductive contact 80 affixed to its underside confined within the dome conic section. The disc spans a space between a pair of stationary spaced-apart contacts 82 on the base plate 18 which, as mentioned, may be a printed circuit board. The stationary contacts 82 may be connected in a desired circuit (not shown). With a button in its normal position, as shown in FIG. 2, its contact 80 is spaced above the stationary contacts maintaining an open circuit condition between the pair of contacts 82.

When a button 15 is depressed by manual pressure applied to its top surface 32, the button travels downwardly in a translatory pattern since the hinge arms 40 will yield to the downward force in its narrow thickness length and adjacent its mounting to the cross brace 46. As the button descends, its nose portion 36 depresses the dome upper walls and lower section 72 to force the disc 74 downwardly, the disc contact 80 engages the pair of stationary contacts 82 to close a circuit path between these contacts.

When the depressing force is removed from the button 15, the dome inherently restores to its normal shape. The disc 74 rises opening the circuit path and the button is restored by the resilient force applied by the dome and assisted by the hinge.

Figure 5:
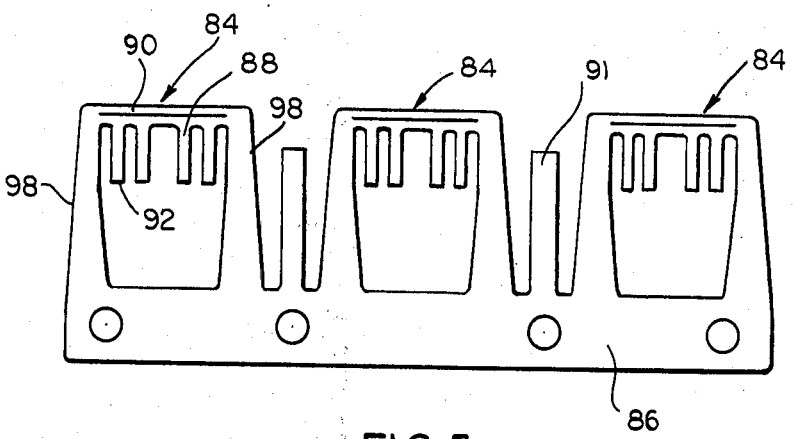
FIG. 5 is a plan view of a second type of row contactor usable with my invention.

In FIG. 5, I show three contactors 84 joined to form a unitary row of contactors. The row of contactors is cantilevered from a common mounting along one edge 86 of the row, the mounting adapted to communicate with the mounting tubes 60 of the button alignment as seen in FIG. 3. Each contactor 84 has a comb like contacting end 88 with a solid bar 90 forming the button engaging surface and angled contact teeth 92 extending therefrom. Each end of the bar 90 is connected to the mounted end 86 by a member 98.

Between the contactors 84 are located biased leaf spring members 91 extending from the contactor strip mounting end 86. Spring members 91 rest on the PC board 99 and establish the normal contactor position.

Figure 7:
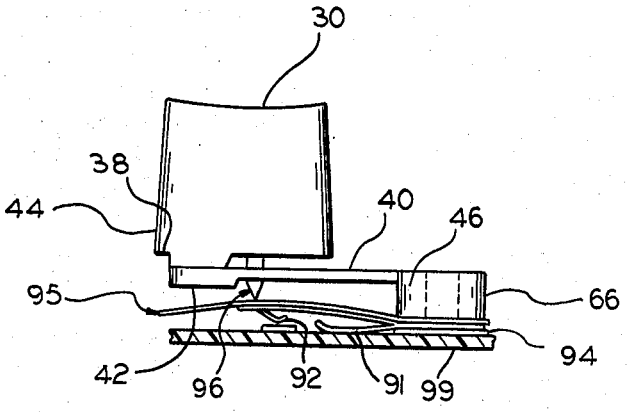
FIG. 7 is a side view in elevation of contactor as in FIGS. 5 and 6 with a button of the type generally shown in FIG. 4.

As shown in FIG. 7, the row of contactors are spaced from the PC board 99 by an insulator 94 at their mounting end and are covered by a resilient moisture barrier 95 aligned between the contactors and the level of operating buttons. It should be noted that FIG. 7 only shows a portion of the PC board 99 and accordingly only shows a portion of barrier 95. It is to be understood that both PC board 99 and barrier 95 extend to the left and that the extended left end of barrier 95 is secured to the PC board 99 in a manner similar to the resilient layer 16 of the embodiment of FIG. 1. As is well-known the moisture barrier protects the contact operating members from ambient conditions such as moisture. In the view of FIG. 7, the button 30 has extended nose portion 96 at its lower extremity. Contactor bar 90 positioned underneath the nose portion 96 holds the button 30 in its normal unoperated condition.

Figure 6:
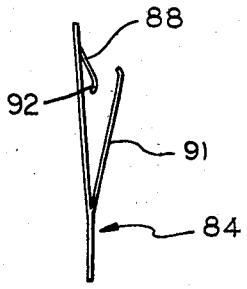
FIG. 6 is a side view of the contactor of FIG. 5.

As is conventional, depression of a button 30 depresses the contactor 84 from its normal open circuit condition to place its central contacting tooth 92 into electrical contact with the stationary contact on the PC board 99. The embodiment of FIGS. 5, 6 and 7 uses the same hinge construction for the button as the prior embodiment with a more conventional form of movable contactor than that of the embodiment of FIGS. 1–4.

I claim:

1. A keyboard assembly comprising an appearance housing having a plurality of apertures in the face thereof arrayed in rows and columns, an array of headed push buttons, with one of said buttons extending outward of each of said apertures, said buttons independently operative to control the operation of respective switching paths, a rigid cross brace commonly connected to a row of buttons, a pair of resilient hinge arms affixed to each push button at the opposed sides thereof, said hinge arms extending from a connection to said cross brace spaced from a first end of said button past the body of the button to the affixation to the button adjacent an end of said button remote from the first end, each of said buttons constrained to substantially vertical movement within raised walls surrounding its respective aperture in the appearance housing, said cross brace held internally within said housing with said hinge arms extending adjacent the lower edges of the sides of the buttons within the appearance housing, whereby a downward force exerted on one of said buttons results in approximate translatory movement of said button.

2. A keyboard assembly as claimed in claim 1, in which said hinge arms are integrally connected to said cross brace and said arms are integrally connected to the sides of the respective buttons.

3. A keyboard assembly as claimed in claim 1, in which there are a plurality of domed resilient insulating members in columns and rows aligned with the plurality of buttons, each said domed member engaging the underside of a button to apply a restoring force to hold the button in its normal, unoperated state, spaced-apart electrical contacts, each said resilient member being individually deformable on operation of its button to close a circuit path between said spaced-apart electrical contacts responsive to depression of the operated button against the force of said resilient member.

4. A keyboard assembly as claimed in claim 3, wherein said insulating members comprise raised portions of a sheet of resilient material.

5. An array of push buttons adapted for independent operation, comprising a rigid cross brace commonly connected to said buttons and spaced a distance from one end of all said buttons, a pair of resilient hinge arms affixed to each push button at both lateral sides thereof, each hinge arm connected to said cross brace and extending from its connection to said cross brace past the major portion of the body of the button to the affixation to the button adjacent the end of the button opposite said one end, means constraining each of said buttons to substantially vertical movement, said hinge arms normally extending in a common plane adjacent the lower edges of the sides of the buttons whereby on depression of a button its hinge arms pivot adjacent the one end thereof to approximate translatory movement.

6. A keyboard assembly as claimed in claim 5, in which said hinge arms are integrally molded with said cross brace and said arms are integrally molded with the sides of the respective buttons.

7. A keyboard assembly as claimed in claim 5, in which there are electrical contacts beneath each button normally maintaining an open electrical circuit condition, and movable contactors, one associated with each button for closing an electrical circuit to the contacts below a button responsive to depression of the respective button.

8. A manually operable push button comprising a top surface adapted to be manually depressed in a translatory manner, and a bottom portion, a normally open electrical circuit adjacent said bottom portion of said button and adapted to be closed responsive to depression of the button, a brace spaced from one end of said button, substantially parallel hinge arms extending from a connection to said brace past the respective lateral sides of the button to a connection to the button adjacent the end of the button opposite said one end, the connection of the arms to the button being adjacent the bottom portion of the button; said button, said hinge arms and said brace being integrally molded as a unit, said brace being essentially rigid and said hinge arms being generally resilient along substantially their entire length to render said button depressible about the connection of the hinge arm to the brace, whereby a downward force exterted on said button results in approximate translatory movement of said button.

* * * * *